US005490301A

United States Patent [19]

Droeser et al.

[11] Patent Number: 5,490,301

[45] Date of Patent: Feb. 13, 1996

[54] ROLLER BRUSH FOR SWEEPING MACHINES

[75] Inventors: Walter Droeser; Hans Ekholm, both of Västerås, Sweden

[73] Assignee: Filippa I Vasteras Handesbolag, Vasteras, Sweden

[21] Appl. No.: 341,180

[22] Filed: Nov. 18, 1994

[30] Foreign Application Priority Data

Nov. 19, 1993 [SE] Sweden ..... 9303835

[51] Int. Cl.[6] ..... A46B 7/10

[52] U.S. Cl. ..... 15/183

[58] Field of Search ..... 15/179, 181–183

[56] References Cited

U.S. PATENT DOCUMENTS

| | | | |
|---|---|---|---|
| 403,973 | 5/1889 | Swann et al. | 15/183 |
| 435,304 | 8/1890 | Hendershot | 15/183 |
| 468,458 | 2/1892 | Slawson | 15/179 |
| 887,780 | 5/1908 | Eberhardt | 15/183 |
| 968,820 | 8/1910 | Vardell | 15/183 |
| 986,679 | 3/1911 | Bowditch | 15/183 |
| 1,011,831 | 12/1911 | Murray | 15/183 |
| 1,018,327 | 2/1912 | Krupp | 15/183 |
| 2,442,480 | 6/1948 | Anderson | 15/183 |
| 2,450,679 | 10/1948 | May | 15/183 |
| 2,767,418 | 10/1956 | Lombardi | 15/183 |
| 2,970,333 | 2/1961 | Jones | 15/183 |
| 3,225,389 | 12/1965 | Jones | 15/183 |
| 3,228,053 | 1/1966 | Horton et al. | 15/183 |
| 3,241,172 | 3/1966 | Tilgner | 15/183 |

FOREIGN PATENT DOCUMENTS

| | | | |
|---|---|---|---|
| 1096009 | 12/1954 | France | 15/183 |
| 148295 | 12/1954 | Sweden | 15/183 |
| 109394 | 9/1917 | United Kingdom | 15/183 |

*Primary Examiner*—Mark Spisich

*Attorney, Agent, or Firm*—Watson, Cole, Grindle & Watson

[57] ABSTRACT

A roller brush for sweeping machines includes an axle (1) which carries distance members (2, 3) which in turn carry profile bars (4) which are arranged along a circumference of the roller brush. The profile bars (4) in turn carry bristle bars (6) provided with bristle members (6.1) which are arranged to protrude mainly radially from the roller brush. One or more cover bars (5) are arranged between adjacent profile bars (4) along the circumference. The cover bars (5) are preferably developed with equal width along the circumference of the roller brush whereby the profile bars (4) are spaced at equal relative distance along the circumference.

3 Claims, 2 Drawing Sheets

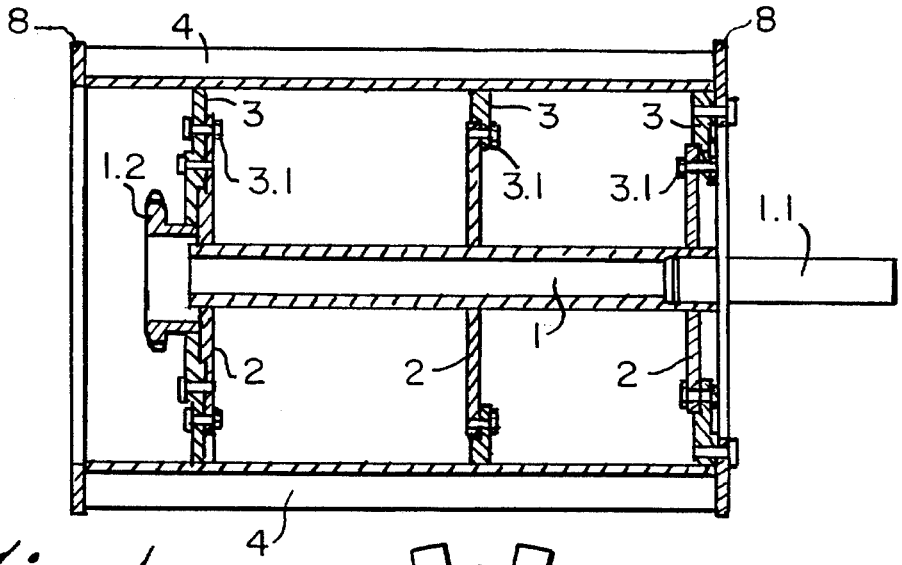
Fig. 1.
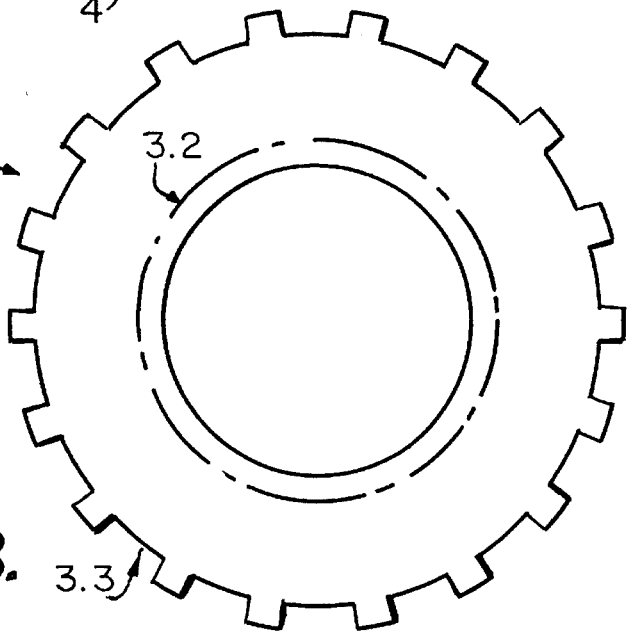
Fig. 2.
Fig. 3.
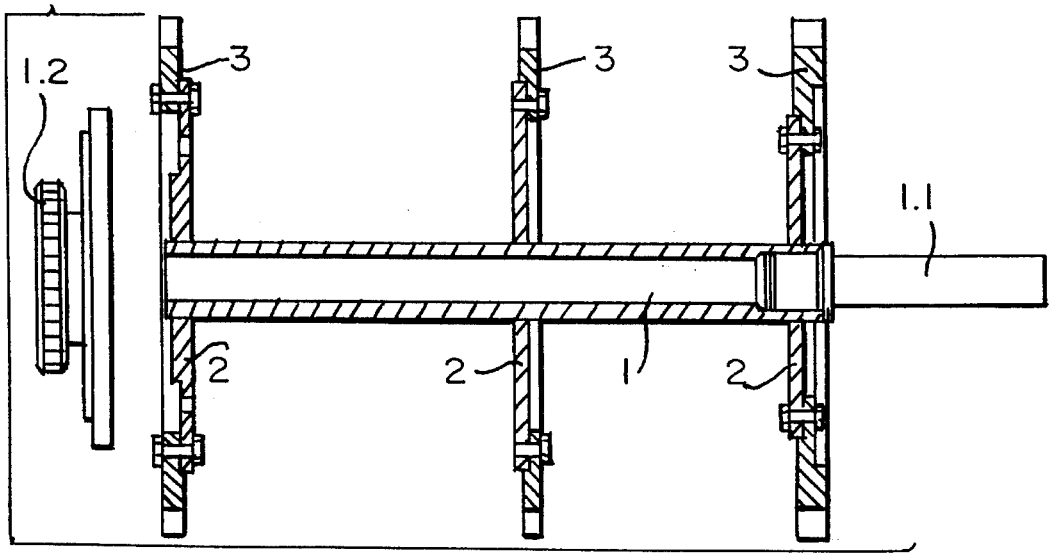

ROLLER BRUSH FOR SWEEPING MACHINES

TECHNICAL FIELD

The present invention relates to a roller brush for sweeping machines and comprises an axle carrying distance members which in turn carry profile bars arranged along a circumference of the roller brush. The profile bare in turn carry bristle bars provided with bristle members aggranged to mainly protrude radially from the roller brush.

BACKGROUND TECHNICS

About roller brushes for sweeping machines it has been known to arrange elongated axial bristle bars along the circumference of the roller brush, the bristle bars being arranged in notches in disc-shaped members, which in turn are arranged along the roller brush. An example of such a roller brush is described in U.S. Pat. No. 4,302,863. The roller brush described comprises an elongated axle carrying discs provided with notches to which profile bars are welded. Bristle bars with protruding bristle members then are slid into notches in the profile bars directed towards each other in such a way that the bristle members are protruding radially from the roller brush.

The known roller brush has the disadvantage that dust, powder, snow or the like easy can accumulate unequally distributed inside the roller and cause unequally distributed mass forces, which in turn causes vibrations in the entirety or the unit. A further disadvantage with the known roller brush is that one and the same material, e.g. steel, has to be chosen for all its components exept for the bristle bars, as the components in question are welded together.

Further examples or less similar embodiments or roller brush constructions comprising profile bars carrying bristle bars are known, Since it also is desired to constantly lower the costs of production For roller brushes it has been shown that the hitherto known constructions do not offer sufficiently effective solutions to keep the costs of production low. Therefor there is a reason to leave the hitherto known solutions behind, both concerning the construction and the choice of material For the components which are part of the roller brushes.

SUMMARY OF THE INVENTION

The object or the present invention is to achieve a roller brush for sweeping machines not showing the disadvantages or the hitherto known roller brushes. The object is achieved with a roller brush which comprises an axle which carries distance members which in their turn carry profile bars, arranged along a circumference of the roller brush. The profile bars in turn carry bristle bars provided with bristle members arranged to protrude mainly radially from the roller brush.

The roller brush according to the invention is characterized in that cover bars are arranged between adjacent profile bars along the circumference of the roller. Those cover bare prevent e.g. dust or snow to penetrate into the roller and to cause the trouble mentioned above. The term cover bar is used here as a comprehensive term, for all kinds or members which could be arranged to cover an interspace between two adjacent profile bars. It also lies within the scope or the invention that the mentioned interspace is covered by means or two or more cover bars arranged behind each other along the profile bars.

The roller brush according to the invention can have a variable number of the bristle bars along the circumference of the roller by arranging cover bars of different width on different rollers. Thereby, it is achieved that roller brushes with different numbers of bristle bars can have the same circumference which can be desirable, if the same circumference speed is desired at the exterior ends of the bristle members with the same number of revolutions of the roller brush.

Since it is an advantage to make the profile bars from extruded aluminium, they have to be carried by member, e.g. disc- or ring-shaped distance members arranged on an axle, even those made from aluminium in order to be able to weld together the profile bars and the distance members. As it is furthermore preferred to make the main axle of the roller brush from steel it is feasible to combine both wants by means of the proposed roller brush which, according to the invention, provides components of both materials such a combination results in a roller brush which can be produced for relatively low costs, but which fulfils the claim regarding strength and rigidity and which also runs regulary, i.e. is free from vibrations.

Further details and features according to the invention are evident from the description of the accompanying drawings and from the claims.

BRIEF DESCRIPTION OF THE DRAWINGS

The invention is further described with reference to the embodiment shown in connection with the accompanying drawings, wherein.

FIG. 1 shows an assembled roller brush according to the invention in, a longitudinal section but without bristle bars;

FIG. 2 shows detachedly a plane view of a ring member which is an integral part of the roller brush;

FIG. 3 shows ring members assembled on discs arranged along the axle of the roller brush in a longitudinal section;

Figure 4:
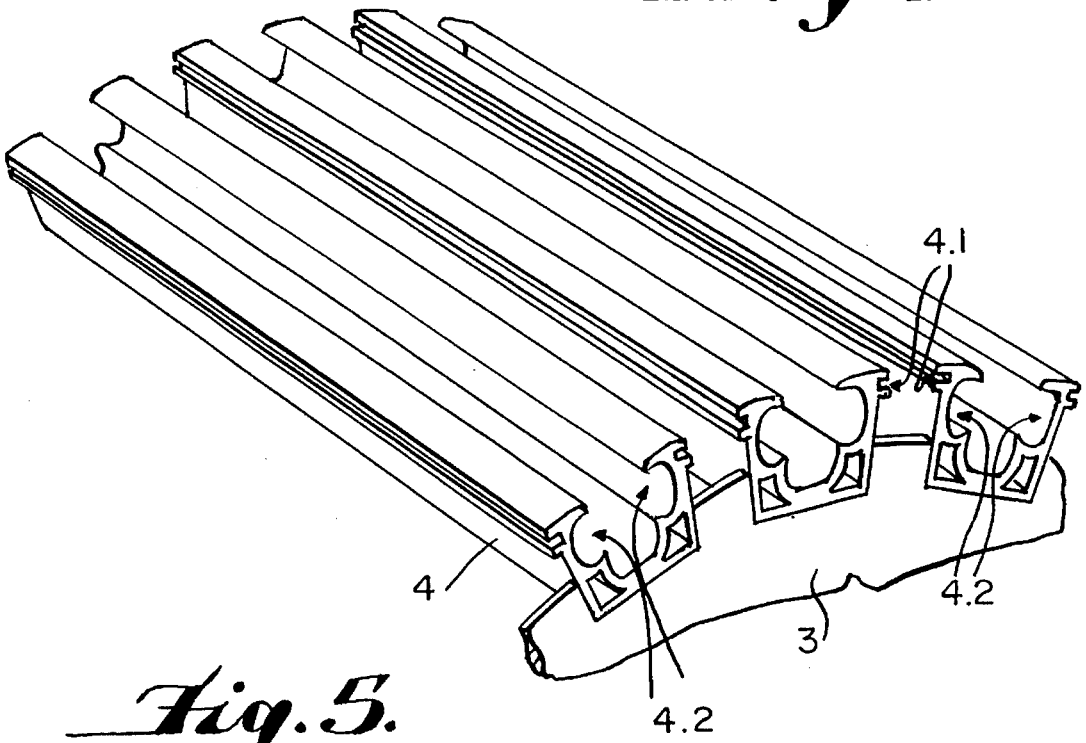
FIG.4 shows profile bars attached to a ring member in a section of the roller brush seen in perspective.

The roller brush shown in FIG. 1 comprises a tube-shaped axle 1 along which there are three discs 2 fixedly arranged, preferably fixedly welded to axle 1. Both the axle 1 and the discs 2 are made from steel. A stub axle 1.1 being intended for bearing protrudes from one end of the axle 1 and a coupling ring with splines 1.2 is arranged at its other end. Each respective disc 2 carries a ring member 3 which is made from aluminum and fastened by means of screws 3.1. The screw holes for the screws 3.1 in the ring member 3 are marked with a dash dotted circular line 3.2 on FIG. 2. Respective ring member 3 presents a circular notch with a somewhat larger diameter than the exterior diameter of the corresponding disc 2 through which the ring member 3 is centered onto the disc 2 during assembly. The middle one of the three ring members 3 shows an interior diameter being larger than the exterior diameter of one of the discs 2, the left one on FIG. 1, on the axle 1.

Figure 5:
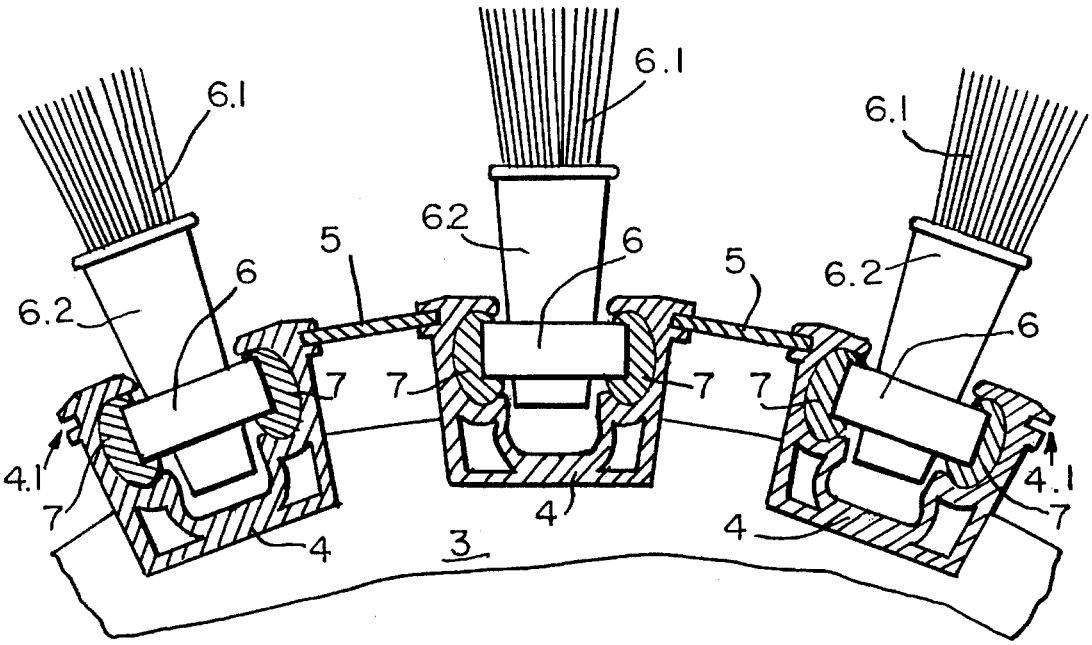
FIG. 5 shows the profile bars according to FIG. 4 seen in the axle direction of the roller brush and with bristle bars inserted into the profile bars.

As is evident from FIG. 2 the respective ring member 3 also presents radial notches 3.3 equally divided along the circumference of the member, in which profile bars 4 of aluminium are intended to be arranged by welding as is shown in FIG. 5.

In assembling the roller brush according to the invention, as is evident from the example shown in the figures, and proceeding from an axle 1 with discs 2 welded on, first the middle one of the ring members 3 is introduced upon the right disc 2 in FIG. 3 and is tightened to the middle one of the discs 2 on axle 1. Then the other two ring members 3 are tightened to the gables of the corresponding discs 2. In the example shown in the figures all ring members 3 present the same exterior profile and are arranged for the radial notches 3.3 to run together along a line parallel to the axle 1 of the roller brush. The right rang member 3 shown in FIG. 3 presents a smaller interior diameter than the ring member 3 in the middle whereas the left ring member 3 presents a larger interior diameter to allow the assembling of the splines ring 1.2 to the corresponding disc 2 inserted in the center opening of the ring member 3. After assembling the ring members 3 to corresponding discs 2' the profile bars 4 are arranged into the notches 3.3 in the ring member 3 and are welded to them as is symbolicly shown in FIG. 5. IF necessary a cover bar 5 will be arranged in the notch 4.1 in the adjacent profile bars 4 in connection with those being arranged in the notches 3.3 in the ring members 3. The cover bars 5 may even be slid into the notch 4.1 in the profile bars 4 after those being welded to the ring members 3.

In this state the roller brush is ready for the assembling of bristle bars 6 presenting bristle members 6.1 kept together in holder 6.2. As shown in the example, the bristle bars 6 may be made from plate and slid into slide bars 7 which are arranged towards each other directed slide ways 4.2 along the respective interior of the profile bar 4. Then the bristle bars 6 are fixed against sliding in its longitudinal direction by means of gables 8, as shown in FIG. 1, the right gable 8 in the figure being screwed to the nearest ring member 3. The bristle bars 6 also may be made from other materials like plastic or combinations of plastic and metal.

We claim:

1. A roller brush for sweeping machines comprising a rotatable axle, carrying members mounted on said axle for rotation therewith, profile bars connected to said carrying members and being spaced a distance radially from said axle, each said profile bar extending in a direction parallel to said axle and having an exterior surface with a trough therein opening in a direction outwardly relative to said axle and extending parallel to said axle, said troughs each housing bristle members therein which protrude radially outwardly relative to said axle, said profile bars each having notches on opposite sides of the respective trough and each notch having an opening which is substantially normal to the respective trough and each notch further adjacent notch in an adjacent profile bar, said notches extending parallel to said axle, and a plurality of cover bars each being seated in a respective one of the pairs of facing notches of adjacent profile bars, said cover bars preventing dust or snow from lodging between adjacent profile bars.

2. A roller brush as defined in claim 1, wherein said carrying members each include an inner portion comprising a steel disc having a first diameter and an outer portion made of an aluminum disc having a second diameter which is greater than said first diameter, the respective and outer portions are screwed together, said axle is comprised of steel, said inner portions of said carrying members are welded to said axle, said profile bars are comprised of aluminum, and said outer portions of said carrying members are welded to said profile bars.

3. A roller brush as defined in claim 2, wherein said outer portions of said carrying members have notches along the outer peripheries thereof for seating said profile bars and providing a surface for said profile bars to be welded onto.

* * * * *